United States Patent [19]

Solloway

[11] Patent Number: 5,031,904

[45] **Date of Patent: * Jul. 16, 1991**

[54] AQUATIC BOOT

[76] Inventor: Daniel S. Solloway, 11121 Ashford Dr., Yukon, Okla. 73099

[ * ] Notice: The portion of the term of this patent subsequent to Oct. 25, 2000 has been disclaimed.

[21] Appl. No.: 208,740

[22] Filed: Jun. 20, 1988

[51] Int. Cl.[5] ..... A63B 23/04

[52] U.S. Cl. ..... 272/116; 272/96; 272/130

[58] Field of Search ..... 272/71, 93, 96, 116, 272/130; 441/55, 60, 61, 62, 63, 64, 76, 77; 434/254

[56] References Cited

U.S. PATENT DOCUMENTS

| | | | |
|---|---|---|---|
| 1,192,650 | 7/1916 | Leitner | 441/60 |
| 1,637,565 | 8/1927 | Gordon | 272/96 |
| 2,017,463 | 10/1935 | Komadina | 441/62 |
| 2,792,577 | 5/1957 | Boyers | 441/60 |
| 2,898,611 | 8/1959 | Mooney | 441/60 |
| 4,411,422 | 10/1983 | Solloway | 272/116 |
| 4,565,369 | 1/1986 | Bedgood | 272/130 |
| 4,627,613 | 12/1986 | Solloway | 272/116 |
| 4,813,668 | 5/1989 | Solloway | 272/71 |

FOREIGN PATENT DOCUMENTS

| | | | |
|---|---|---|---|
| 2014048 | 8/1979 | United Kingdom | 441/60 |

*Primary Examiner*—Stephen R. Crow
*Attorney, Agent, or Firm*—Thomas W. Tolpin

[57] ABSTRACT

An aquatic exercise boot is provided for interchangeable and comfortable use by men, women and children alike. The aquatic exercise boot permits a large range of movement and increased resistive forces, torque and torsion. The aquatic exercise boot serves as fluid resistors to water flow as the aquatic boot is moved through the water. The aquatic exercise boot can have internally padded aquatic foot, ankle, and leg assemblies with symmetrical Z-shaped fins. The aquatic foot, ankle, and leg assemblies can be pivotally connected to each other by vertical hinges and can be strapped, sewn, fastened, glued, or otherwise connected to a zippered elastomeric aquatic sock with an open toe portion.

11 Claims, 4 Drawing Sheets

AQUATIC BOOT

BACKGROUND OF THE INVENTION

This invention relates to exercise equipment, and more particularly, to an exercise boot for use in water.

A variety of weight lifting and exercise devices equipment, such as barbells, have been developed over the years. Typifying these weight lifting and exercise equipment and other devices are those shown in U.S. Pat. Nos. 373,692; 654,097; 660,692; 717,041; 1,260,931; 1,636,316; 1,366,200; 1,676,689; 2,143,337; 2,792,577; 2,898,611; 3,260,523; 3,127,022; 3,463,492; 3,671,987; 3,809,397, 3,867,734; 3,889,308; 4,029,312; 4,227,273; 4,300,759; 4,311,306; 4,411,422; 4,416,451; 1,458,896; 4,624,015; 4,468,023; 4,521,011; 4,627,613; 4,632,387; 4,685,226; Des. 190,605; Des. 224,935; Des. 495,769; Des. 1,906,056; German Patent 351,627; Italian Patent 615,402; British Patent 8,729; British Patent 13,630; British Patent 495,769; and British Patent 1,041,324. These weight lifting and exercise devices have met with varying degrees of success.

Conventional weight lifting and land exercise equipment, however, are often relatively awkward, cumbersome and complex and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional land exercise devices exert an excess amount of torque and torsion (twist) on the joints of the user and are, therefore, not usually suitable for many types of physical therapy.

It is, therefore, desirable to provide an improved aquatic exercise boot which overcomes most, if not all, of the above disadvantages.

SUMMARY OF THE INVENTION

An improved hydrodynamic aquatic exercise boot is provided for use in water to strengthen muscles, improve muscle tone, and enhance muscular coordination. Advantageously, the aquatic boot is readily usable by men, women and children alike, having different strengths and physical capabilities without substantial modification.

The aquatic boot of this invention is particularly useful for physical therapy in water because the torque, torsion and resistant forces which it exerts on the joints of the patient can be readily controlled by the physical therapist, by simply varying the acceleration or momentum of the aquatic exercise assembly to the desired amount. Desirably, the aquatic exercise boot is easy to use and is relatively simple in design and construction for economy of manufacture.

To this end, the aquatic exercise boot has a composite aquatic foot assembly, leg assembly, and ankle assembly, which are strapped, glued, sewn, or otherwise connected to a special aquatic sock assembly. The foot, leg, and ankle assemblies comprise an aquatic foot section which fits against a top portion of a person's foot, an aquatic leg section which fits against a front portion of the person's lower leg, and an aquatic ankle section which connects the aquatic foot and leg sections and fits upon a front portion of the person's ankle, respectively. The foot, leg, and ankle sections can be internally lined with inner pads or cushions. Each of the sections can include a water-engageable deflector with a water resistant front face and at least one fin. Each of the sections can have a pair of generally V-shaped side fins.

In the preferred form, each of the sections have a symmetrical pair of complementary generally Z-shaped side fins extending from opposite sides of the front face. The side fins of the foot section preferably have triangular lateral bight portions to increase the water resistance of the aquatic boot. In order to raise the side fins of the foot section off the floors of swimming pools and increase the wear and useful life of the boot, the triangular portions are positions at an upward angle of inclination.

The fins of the aquatic boot have imperforate and water-impervious portions which provide water-resistive impingement surfaces to hydrodynamically deflect water and create a pressure head and fluid resistance to water flow as the aquatic boot is moved in the water. Each of the fins are positioned an effective distance to exert a hydrodynamic torque on the person's leg, ankle, and foot as the aquatic boot is moved in the water.

The fins and deflectors are preferably rigid, stationary, and elongated and can be reinforced with braces and crossbars. The fins can have fluid flow passageways or openings to facilitate smoother movement of the boot in the water. The outer fins are preferably polygonal with rounded edges to enhance the safety and effectiveness of the aquatic boot. The fins can also have slits or ribs to facilitate molding.

The foot, ankle, and leg sections are pivotally connected to each other by special hinges mounted in countersunk recesses. The special hinges also desirably prevent lateral sideways movement of the sections relative to each other.

The aquatic sock assembly comprises a curved, flexible aquatic sock that fits about and receives a substantial portion of the person's foot, ankle, and lower leg. Preferably, the aquatic sock is elastomeric and tubular with an opened toed annular foot portion, a heeled annular ankle portion, and an annular leg portion with an elongated zipper or other fastener. In order to minimize wear and increase the longevity of the aquatic sock, the foot portion can have a rubberized composite sole with diamond shaped ribs and can have a thicker section providing a wear resistant zone about the ball of the person's foot.

As used throughout this application, the term "hydrodynamic resistance" means a fluid resistance exerted on the aquatic exercise boot and user when the aquatic exercise boot is moved in or through the water.

A more detailed explanation of the invention is provided in the following description and appended claims taken in conjunction with the accompanying drawings.

DETAILED DESCRIPTION OF THE PREFERRED EMBODIMENT

Figure 2:
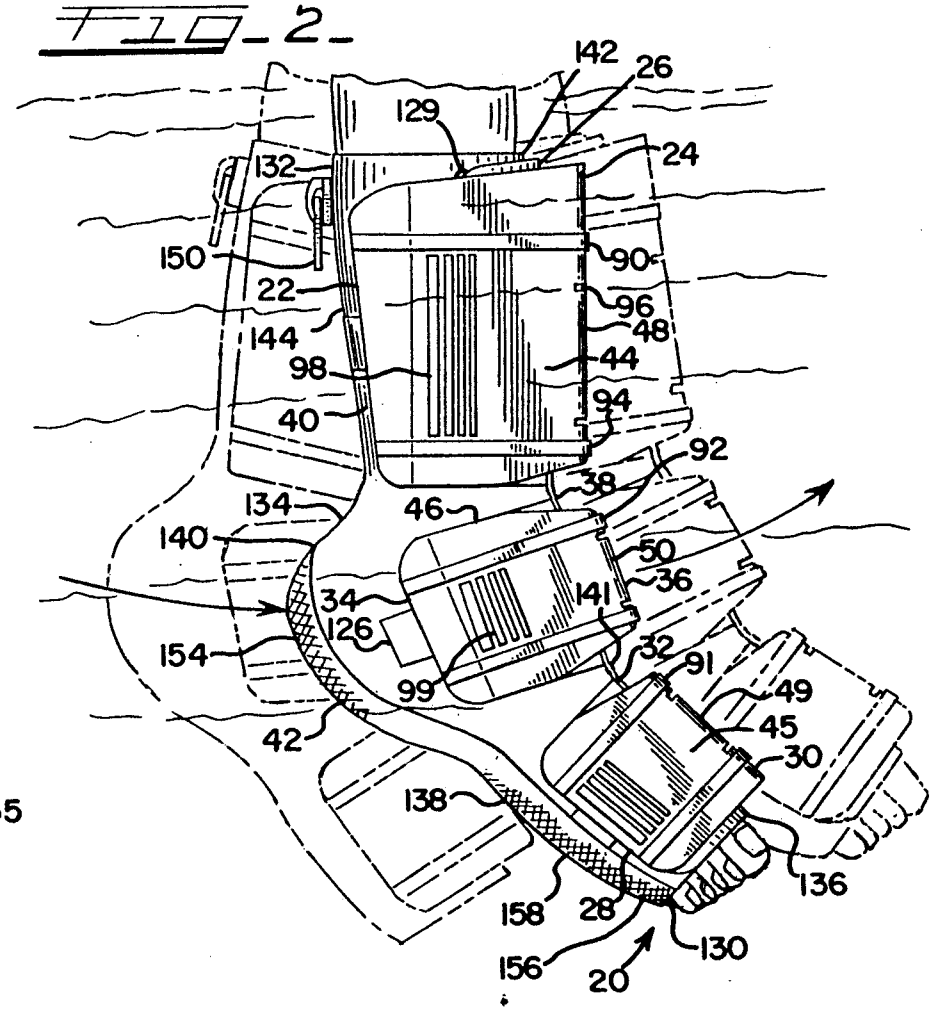
FIG. 2 is a left side view of the aquatic boot when the person is standing on his toes in the water.
Figure 1:
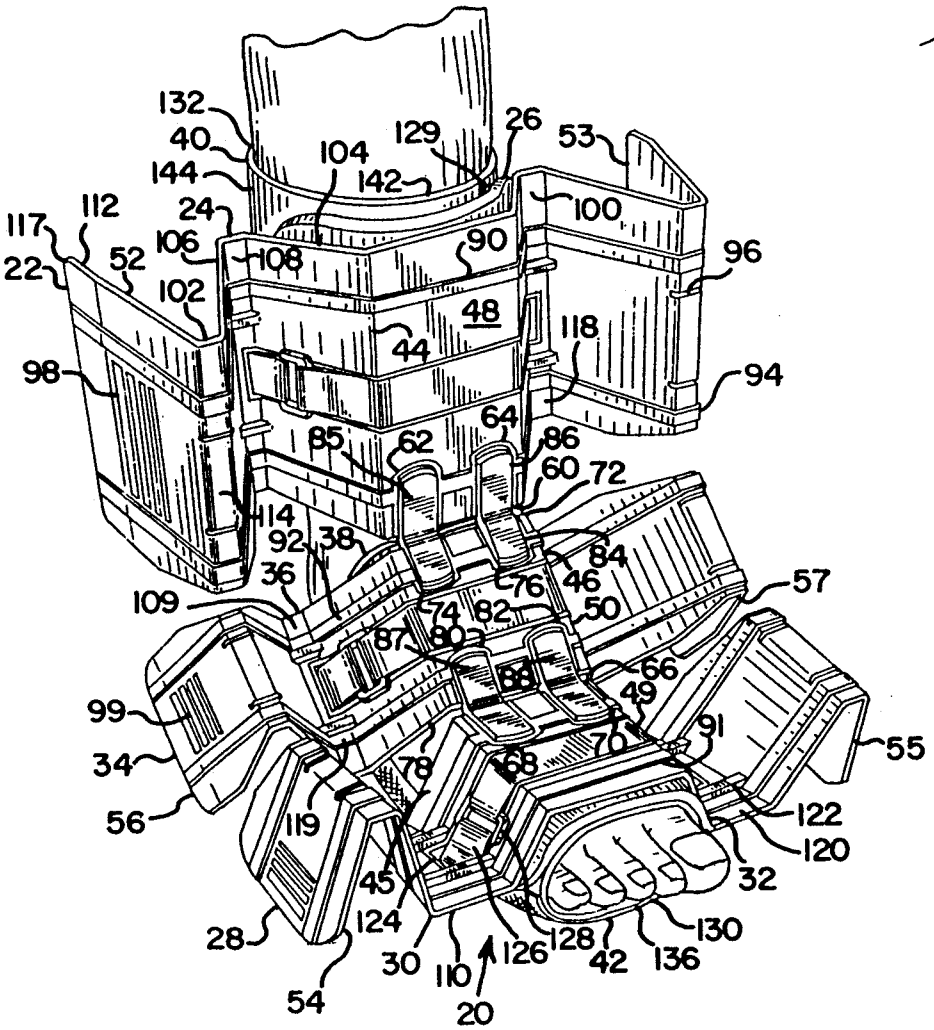
FIG. 1 is a a perspective view of an aquatic boot on a person's lower leg, ankle, and foot in accordance with principles of the present invention.
Figure 4:
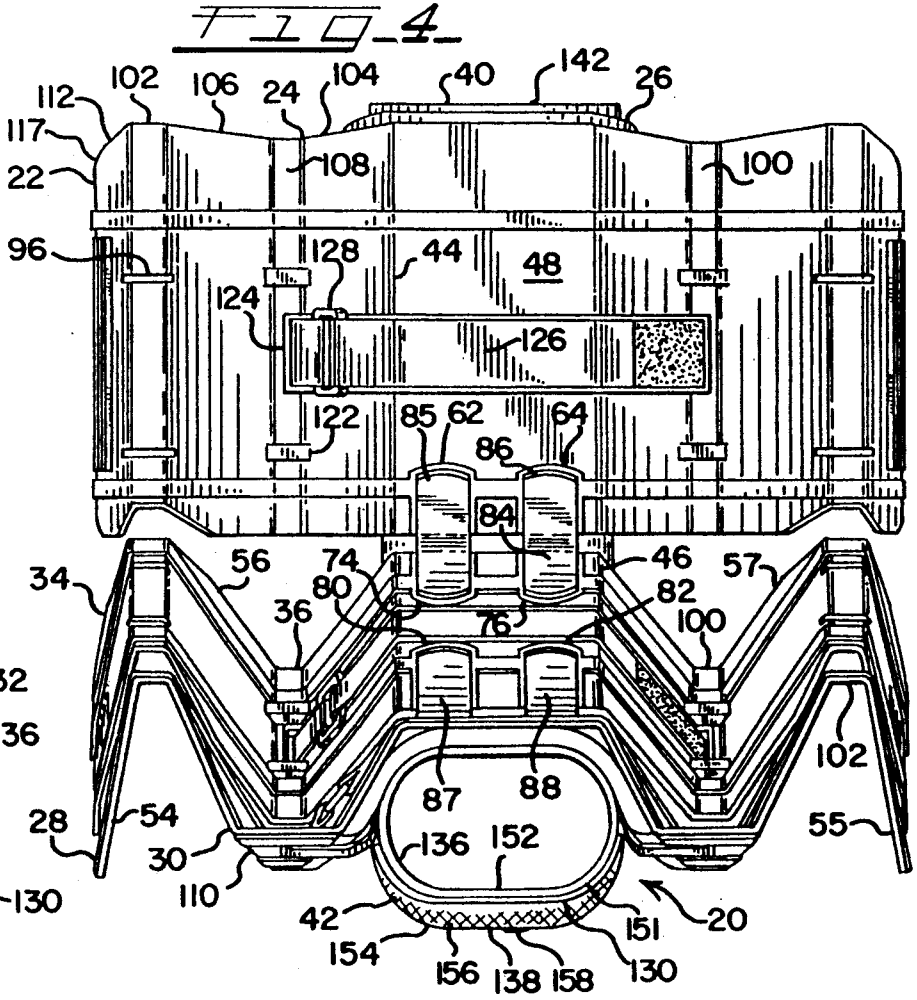
FIG. 4 is a front view of the aquatic boot.
Figure 3:
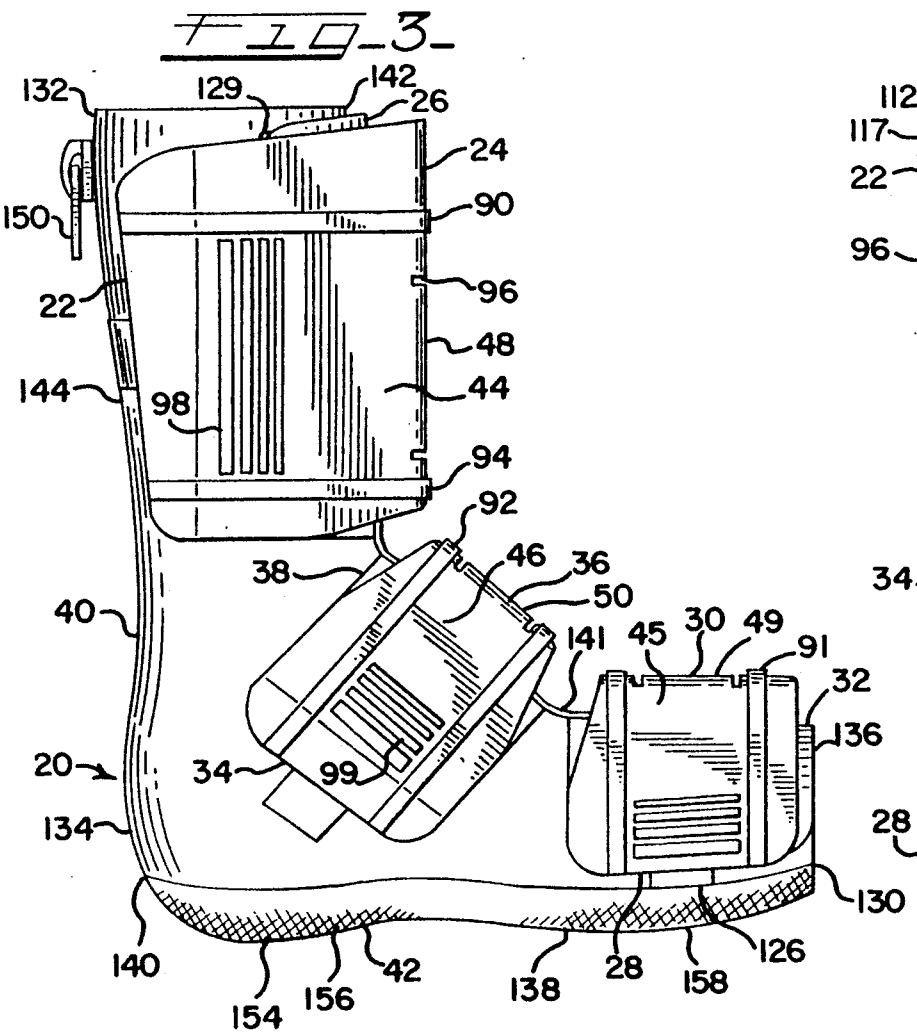
FIG. 3 is a left side view of the aquatic boot.
Figure 6:
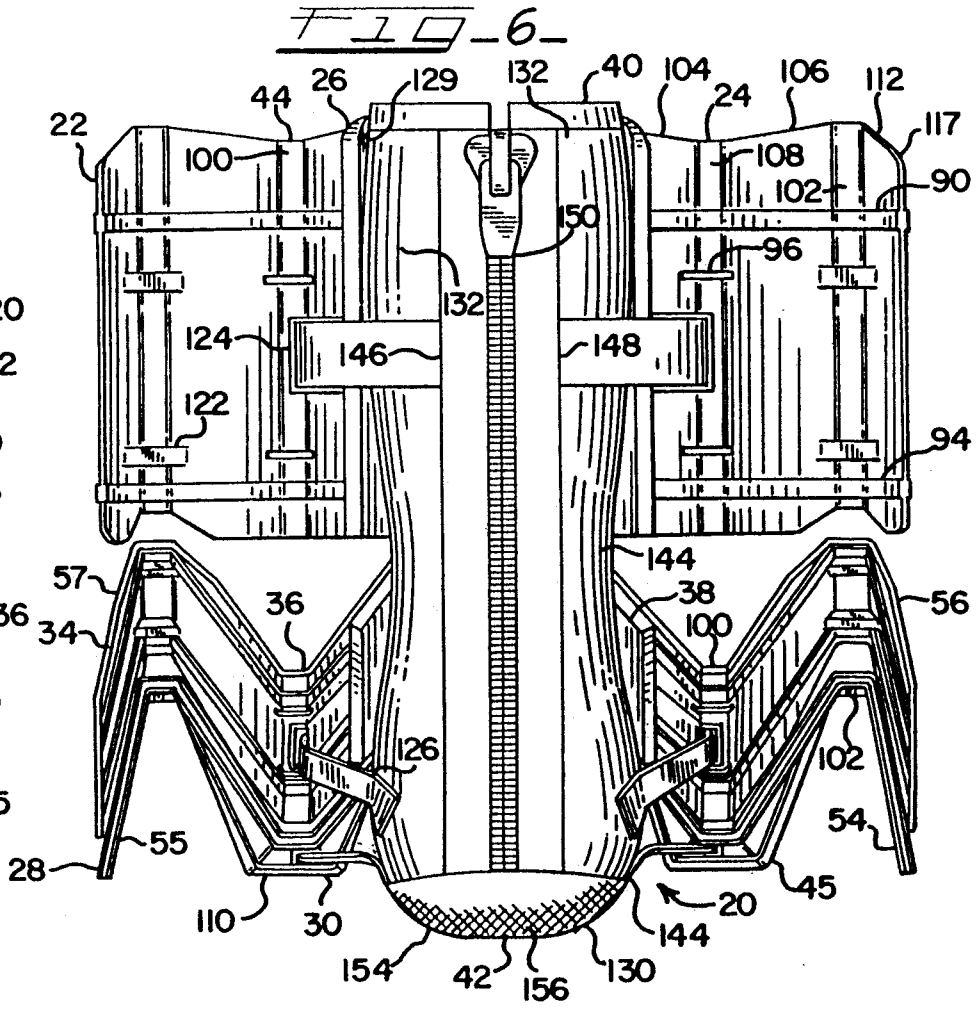
FIG. 6 is a back view of the aquatic boot.
Figure 5:
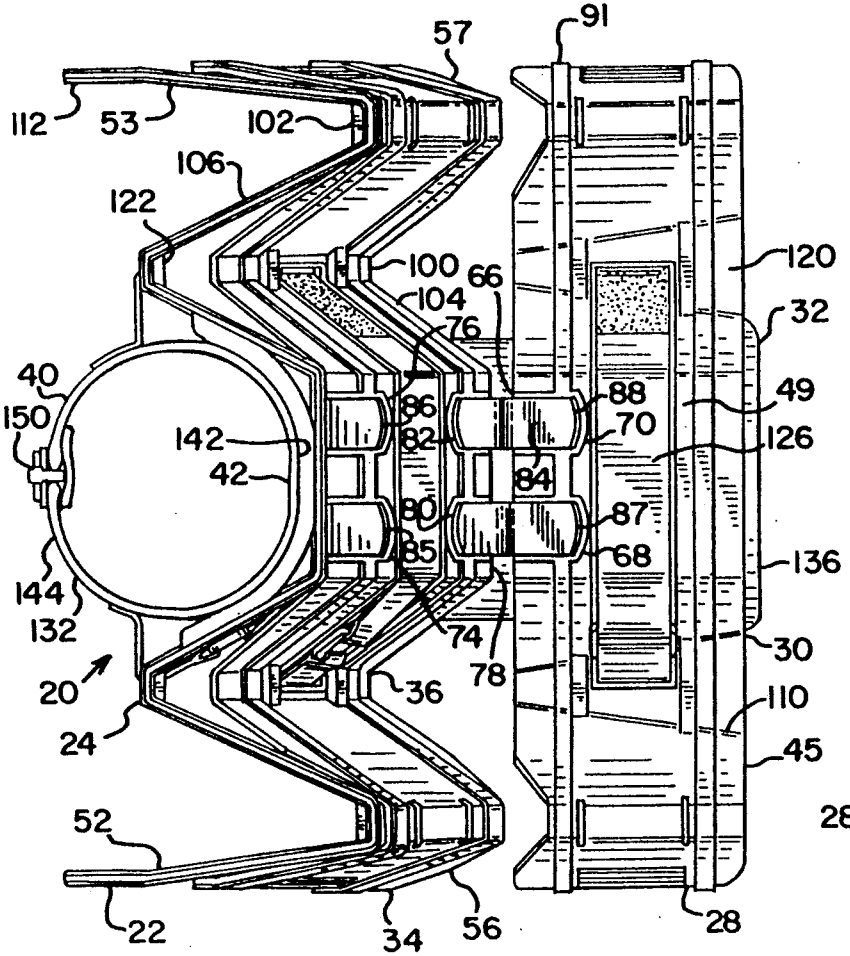
FIG. 5 is a top view of the aquatic boot.
Figure 8:
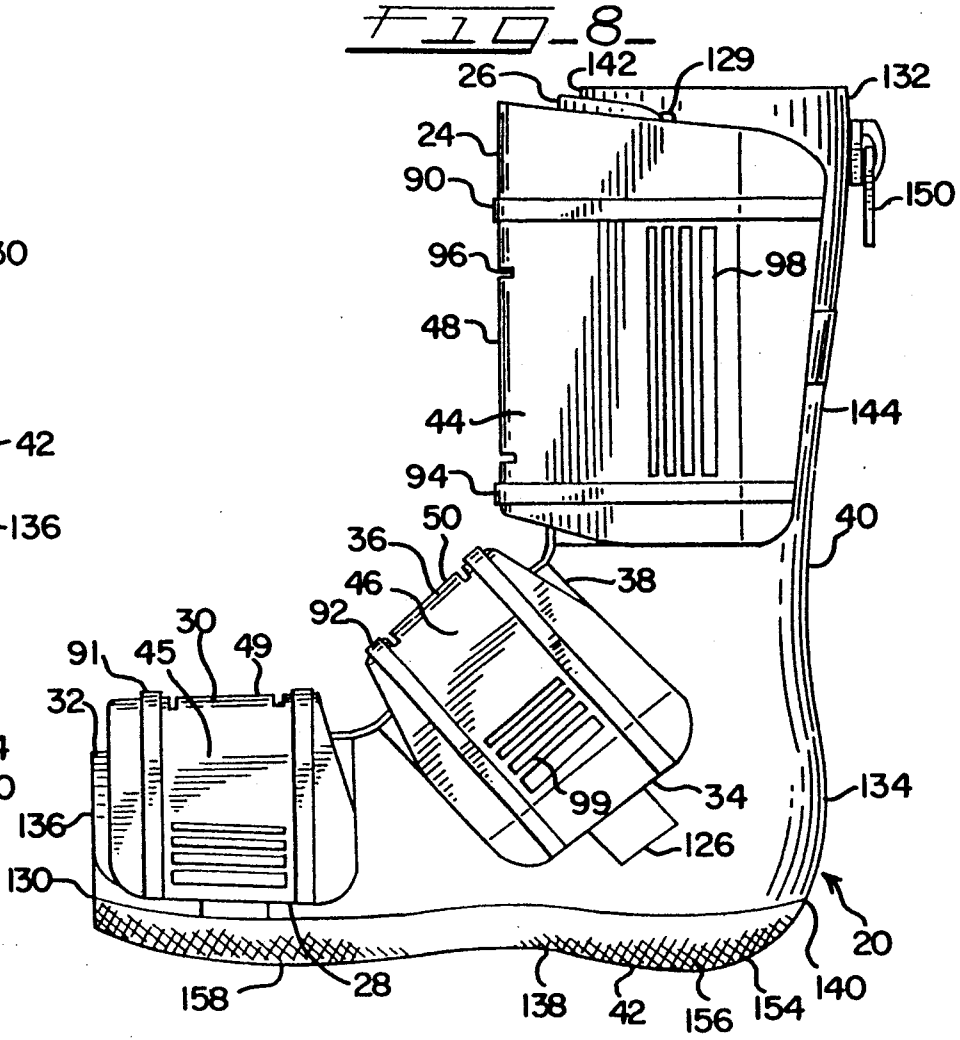
FIG. 8 is a right side view of the aquatic boot.
Figure 7:
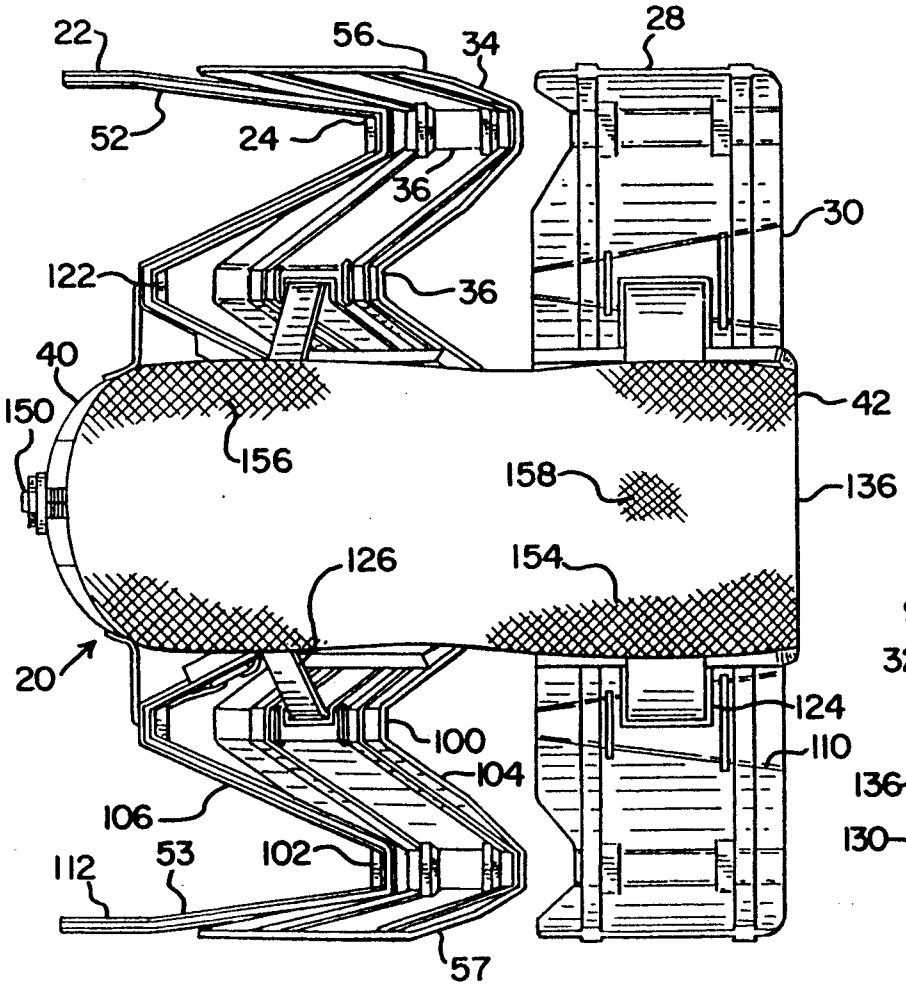
FIG. 7 is a bottom view of the aquatic boot.

The hydrodynamic aquatic leg exercise assembly and exerciser 20 shown in FIGS. 1–8 provides an aquatic exercise boot, hydrodynamic boot, or hydro boot which is compact, easy to construct and effective to strengthen muscles, improve muscle tone and enhance muscular coordination. The aquatic boot 20 is also safe, easy to use, and aesthetically pleasing.

The aquatic boot 20 is designed for use in water and is particularly useful for therapy and recovery from leg injuries as well as to develop leg strength for various sports, such as football, soccer, baseball, running, jogging, basketball, tennis, volleyball, pole vaulting, jumping, etc. The aquatic boot 20 is lightweight, comfortable and portable and permits the exerciser (user) or therapist to control the magnitude of the water forces, torque and torsion exerted on the exerciser's leg, ankle and foot, via the aquatic boot 20, while minimizing harsh impact forces and shock. Control can be attained by varying the acceleration and momentum of the aquatic boot 20.

The aquatic boot 20 can be used by men, women and children of various strengths and ability without changing, adding or removing parts. The aquatic boot 20 can come in various sizes and can also be used by patients and paraplegics to recover from leg and foot disabilities and injuries.

The portable aquatic boot 20 can be comfortably used is in water by patients, paraplegics, and athletes, such as football players, baseball players, basketball players, weight lifters, body builders, runners, joggers, tennis players, raquetball players, hockey players, etc. as well as other persons desirous of strengthening their muscles, improving their muscle tone, and enhancing their muscular coordination.

The aquatic exercise assembly 20 is particularly useful to physical therapists because it permits a greater range of motion in the water than conventional ankle weights, leg weights, and many other types of conventional weight lifting and exercise devices that are used on land, such as in gymnasiums. The aquatic exercise boot 20 is helpful to improve the cardiovascular system and general physical well being and strength of the user.

Structurally, the aquatic exercise assembly 20 is formed of substantially water-impermeable and impact-resistant material, such as impact-resistant plastic and rubber. Other water-impermeable materials can be used.

The aquatic boot 20 has four assemblies or units including an aquatic composite, lower leg assembly 22 comprising an aquatic leg section 24 with an inner shin pad or cushion 26, an aquatic composite foot assembly 28 comprising an aquatic foot section 30 with an inner foot pad or cushion 32, an aquatic composite ankle assembly 34 comprising an aquatic ankle section 36 with an inner ankle pad or cushion 38, and an aquatic composite sock assembly 40 comprising an elastomeric flexible tubular aquatic sock 42. The aquatic leg assembly 22 snugly engages, fits against, and generally conforms to the front portion or shin of the person's lower leg between the kneecap and ankle. The aquatic foot assembly 28 provides an aquatic shoe which snugly engages, fits upon, and generally conforms to the top portion of a person's foot. The aquatic ankle assembly 38 fits about, snugly engages, and generally conforms to the front portion of the person's ankle. The ankle assembly 38 is positioned between and pivotally connected to the foot assembly 28 and the leg assembly 22. The leg assembly 22 is larger than the foot and ankle assemblies 28 and 38. The ankle assembly 38 is smaller than the leg and foot assemblies 22 and 28. The leg, ankle, and foot assemblies are structurally similar except as otherwise noted. The pads 26, 32, and 38 are made of an elastomeric rubber-like cellular foam material, such as closed cell neoprene rubber, that resiliently conforms to and matingly engages the shin, foot, and ankle, respectively, of the person's leg. Other materials can be used. The aquatic sock assembly 40 is connected to the foot, ankle and leg assemblies 22, 28, and 38 and snugly receives, engages against, and covers substantial portions of the person's foot, ankle, and lower leg.

The aquatic leg, foot and ankle sections 24, 30, and 36 have outer, external, generally U-shaped or channel-shaped, water-engageable shin, foot, and ankle deflectors or baffles 44–46 and can have inwardly facing, horizontal arcuate ribs. The deflectors 44–46 have generally planar or flat, leg, foot, and ankle, front faces or plates 48–50 and symmetrical pairs of laterally opposite, complementary Z-shaped or N-shaped leg, foot, and ankle, side fins 52–57 which are integrally connected in fixed relationship to and extend sideways and laterally outwardly from the sides of the faces 48–50, respectively. The deflectors 44–46 and fins 52–57 are substantially rigid, stationary, and elongated and are made of impact-resistant plastic.

The front face 48 of the shin deflector 44 faces forwardly and has a lower edge portion 60 with a parallel pair of similar size, upright, countersunk, inverted U-shaped hinge-receiving recesses 62 and 64. The front face 49 of the foot deflector 45 faces upwardly and has an upper edge portion 66 with a parallel pair of similar size, countersunk U-shaped hinge-receiving recesses 68 and 70, which are generally aligned with recesses 62 and 64. The front face 50 of the ankle deflector 46 faces forwardly and upwardly and has: (a) an upper edge portion 72 with a parallel pair of similar size, countersunk, upper upright, U-shaped hinge-receiving recesses 74 and 76 which are aligned with and positioned adjacent the recesses 62 and 64 of the shin deflector 44; and (b) a lower edge portion 78 with a parallel pair of similar size, countersunk, lower inverted, U-shaped hinge-receiving recesses 80 and 82 which are aligned with and positioned adjacent the recesses 68 and 70 of the foot deflector 45. Hinge assemblies 84 comprising aligned, upper and lower oblong plastic hinges 85–88 are snugly positioned in the recesses 62, 64, 68, 70, 74, 76, 80 and 82, respectively, and connected to the corresponding adjacent parts of the deflectors 44–46 to pivotally and hingeably connect the ankle deflector 46 to the shin and foot deflectors 44 and 45.

Each of the deflectors 44–46 has a parallel pair of horizontal elongated rigid braces 90–92 comprising outwardly protruding front stabilizing crossbars 94 which extend outwardly and horizontally across the entire face and back of the deflector as well as the front and back portions of the fins to enhance the structural strength and rigidity of the deflectors 44–46 and fins 52–57. The fins 52–57 can also have horizontal slits, apertures, or openings which provide fluid flow passageways 96 for passage of water therethrough to enhance drag and more smoothly move the boot 20 in the water. The outer fins can have vertical ribs 98 and/or slits 99 to facilitate faster, more efficient, and better compression molding of the fins.

The Z-shaped or N-shaped fins 52–57 have inner generally V-shaped front pockets 100 and outer generally V-shaped back pockets 102 to cuppingly and resistively engage the water as the aquatic boot 20 is moved forwardly and rearwardly, respectively, in the water. The front pockets 100 comprise inner V-shaped fins which are formed by: (a) inner generally rectangular fins 104 that extends outwardly and rearwardly from the sides of the faces 48–50 at an obtuse angle ranging from about 105 degrees to about 165 degrees, preferably from about 120 to about 150 degrees; (b) intermediate generally rectangular fins 106 that extend outwardly and forwardly or upwardly from adjacent the outer ends of the inner fins 104 at an acute angle ranging from about 30 to about 75 degrees, preferably, about 60 degrees; and (c) inner bights 108–110 extending between and connecting the inner and intermediate fins 104 and 106.

The outer back pockets 102 comprise V-shaped fins which are formed by: (a) intermediate fins 106; (b) outer polygonal fins or wings 112 that extend outwardly and rearwardly or downwardly from adjacent the outer ends of the intermediate fins at an angle ranging from about 30 to 165 degrees, preferably from about 45 to 150 degrees; and (c) outer bights 114 with generally rectangular back portions 116 that extend between and connect the intermediate and outer fins 106 and 112. The outer fins have rounded or chamfered corners 117 to enhance the safety of the aquatic boot 20 and prevent lacerating nearby exercisers, swimmers, and other persons in the water.

The inner bights 108 and 109 of the leg and ankle assemblies 22 and 38 have generally rectangular front portions 118 and 119. The inner bights 110 of the foot assemblies 28 have generally triangular, lateral, front bight portions 120 to enhance fluid resistance to water flow as the aquatic boot is moved through the water. Preferably, the triangular bight portions 120 extend outwardly and upwardly at an angle ranging from about 15 to 75 degrees, preferably from about 30 to 60 degrees, to raise the Z-shaped or N-shaped foot fins 54 and 55 off the floors of swimming pools, as well as off sandy or stony bottoms of ponds, lakes, rivers, or other bodies of water, so as to increase the wear and useful life of the foot fins.

The leg, ankle, and foot assemblies 22, 28, and 38 each have a parallel pair of reinforcing cross members 122 which extend horizontally and laterally across the inner front and back bight portions 118–120 and connect the inner and intermediate fins 104 and 106. The cross members are positioned between and are substantially smaller than the horizontal braces 90–92.

The Z-shaped or N-shaped side fins 52–57 and defectors 44–46 provide increased surface area to effectively resist movement through the water. The fins 52–57 and deflectors 44–46 have water impingement portions that provide water-resistive impingement surfaces and provide hydrodynamic resistance assemblies which hydrodynamically deflect water and create a pressure head and multi-directional fluid resistance to water flow as the aquatic boot 20 is moved through the water. The Z-shaped or N-shaped side fins 52–57 are positioned an effective distance from the front faces 48–50 of the deflectors 44–46 to exert a hydrodynamic torque on the front faces 48–50 and leg, ankle and foot, to strengthen the muscles of the person's leg, ankle, and foot.

The deflectors 44–46 and fins 52–57 provide solid barriers which are substantially imperforate except for strap-receiving holes 124 (FIG. 1), openings or apertures in the middle of the apexes or inner bights 108–110. The holes 124 receive flexible water-resistant straps or belt 126 with D-rings 128 to allow the person to to tighten, secure, or loosen the leg, ankle, and foot assemblies 22, 28, and 38 about the person's leg, ankle, and foot and against the aquatic sock assembly 40 with only one hand when the boot 20 is in the water. The straps 126 are sewn to the aquatic sock assembly 40. The aquatic sock assembly 40 can be fastened to the pads 26, 32, and 38 such as by snaps 129 for more secure assembly and easier replacement of parts of the aquatic boot. While the above arrangement is preferred for ease of use, comfort, and effectiveness, in some circumstances it may be desirable that the sock assembly be glued or bonded by marine adhesive to the inner pads, deflectors, or fins, or that the straps have buckles, latches, VELCRO-type fasteners, or other fastening members or devices. In some circumstances, it may be desirably that more or fewer straps be used. Furthermore, the strap-receiving holes can be omitted if the straps are glued or fastened to the fins.

The aquatic sock 42 (FIGS. 2, 3, and 8) has an annular oval, foot portion 130, an annular circular or oval, lower leg portion 132, and an annular oval, imperforate ankle portion 134 which extends between and is integrally and annularly connected to the foot and leg portion 130 and 132. The foot portion 130 has an open front toe portion 136 and a concave composite, abrasive resistant, floor-gripping, aquatic sole 138. The ankle portion 134 has a rounded heel potion 140 or back and a rounded front portion 141. The lower leg portion 132 has a concave front portion 142 and a concave back portion 144 with back flaps 146 and 148 (FIG. 6) and an upright vertical zipper 150 that extends substantially the entire height of the back portion 144 to a position adjacent the heel portion 140 and detachably connects the back flaps 146 and 148. The back portion 144 can have one or more straps which are sewn or secured to the back portion by VELCRO-type fasteners and have D-rings to allow the exerciser to secure the back flaps without entirely closing the zipper. This is often convenient, such as for persons with large calves.

The composite aquatic sole 138 can have an inner elastomeric resilient core 151 (FIG. 4), an upwardly facing inner TERRY type cloth lining 152, and a downwardly facing, hardened rubberized, outer coating 154. The core 151 is made of a flexible elastomeric material, such as neoprene. Other materials can be used. The cloth lining 152 provides a soft engagement surface which fits upon and against the bottom of the person's foot and the person's heel. The rubberized outer coating 154 preferably has diamond shaped ridges and ribs 156 which helps minimize and prevent wear when the aquatic boot steps on, rubs against, and engages the bottom of a swimming pool or the sandy or stony bottom of a pond, lake, river, or other body of water. The aquatic sole 138 can have an enlarged thickness which provides a wear resistance zone 158 about the ball of a person's foot to increase the longevity and useful life of the aquatic sole 138. While the illustrated composite sole 138 is preferred for best results, in some circumstances it may be desirable that the aquatic sole have more or fewer layers or be made of different materials.

It can, therefore, be seen that each of the fins of the aquatic boot 20 have outer, generally imperforate, water-impingement surfaces which increase hydrodynamic resistance of water flow as the aquatic exercise boot 20 is moved in all directions through the water. The water resistance (resistive forces) exerted by the fins of the aquatic exercise boot 20 as the aquatic boot 20 is moved in the water can be increased by increasing the span, length, transverse width, or height of the fins thereby enlarging the effective cross-sectional area that is positioned generally normal (perpendicular) to the direction of movement of the aquatic boot 20.

The fins and deflectors of the aquatic boot 20 are rigid, stationary, and are made of similar materials. While the illustrated embodiment is preferred for best results, in some circumstances it may be desirable that the fins be removable and replaceable with different size fins, or that the fins expand, be adjustable, or be locked in different positions for different variations in physical therapy and exercise, or that the fins be flexible, curved, foraminous (perforated), moveable, proportioned differently, have different configurations or sizes, be at different angular relationships, or that more or less fins be used. One or more of the fins can be made of fabric, and/or be expandable or moveable, and/or comprise parachute style fins, balloon like fins, sail fins, or bellows type fins. Furthermore, in some circumstances it may be desirable that the pockets have fluid flow passageways, holes, or apertures. Moreover, some exercisers, patients, or other persons may prefer to use the aquatic boot without an internal pad.

The padding (pads) can be snugly positioned against or securely connected to the leg, ankle, foot, and sock assemblies. The padding can also be releasably attached to the leg, ankle, foot, and sock assemblies, such as with snaps or VELCRO-type fasteners. Different layers of padding can also be used.

While the aquatic boot preferably has a leg section with detachable flaps which are releasably connected by an elongated upright zipper for ease of insertion and removal of the boot from the user's leg, in some circumstances it may be desirable to use more than one zipper, or a different positioned zipper, or snaps, buttons, lace, string, or VELCRO-type fasteners to close the flaps. Furthermore, in some circumstances it may be desirable that the top or one or both sides of the foot portion of the aquatic sock have detachable flaps which are releasably connected by a zipper, snaps, shoe laces, or VELCRO-type fasteners.

While the illustrated aquatic boot is preferred, some persons may desire to use a rigid or pivotable calf-engaging clam shell with one or more sections instead of an aquatic sock. The clam shell can also have one or more rearward fins and/or side fins for increased water resistance. Moreover, while the illustrated embodiment is preferred for best results, some persons may prefer to use only some of the components of the aquatic boot, such as the ankle and foot sections, or the ankle and leg sections, etc.

The aquatic exercise boot 20 provides an omni directional resistance device with a wider range of movement in the water and less stress on the joints of the user than is attainable with most types of conventional exercise devices that are used on land and offers many advantages to physical therapists. The aquatic exercise boot 20 also provides more water-resistive surface area and attains greater fluid resistance than larger conventional exercise devices.

Among the many advantages of the novel aquatic boot are:

1. Superior fluid resistance.
2. Outstanding hydrodynamics.
3. Improved aquatic exerciser.
4. Enhanced capability for physical therapy.
5. Greater ranges of aquatic exercises.
6. Quicker and more fuller strength development.
7. Better exercise workout in water.
8. Excellent structural strength and integrity.
9. Attractive.
10. Simple to use.
11. Safe.
12. Convenient.
13. Comfortable.
14. Portable.
15. Compact.
16. Economical.
17. Reliable.
18. Efficient.
19. Effective.

Although embodiments of the invention has been shown and described, it is to be understood that various modifications and substitutions, as well as rearrangements of parts, can be made by those skilled in the art without departing from the novel spirit and scope of this invention.

What is claimed is:

1. An aquatic boot for use in water to strengthen muscles, improve muscle tone and enhance muscular coordination, comprising:

an aquatic foot section for fitting against a top portion of a person's foot;

an aquatic leg section for fitting against a front portion of the person's lower leg;

an aquatic ankle section connecting said aquatic foot section to said aquatic leg section for fitting upon a front portion of the person's ankle;

each of said sections having at least one fin;

a curved flexible aquatic sock connected to said sections for receiving a substantial portion of the person's foot, ankle, and lower leg; and said aquatic sock having an annular foot portion, an annular leg portion, and an annular ankle portion integrally connecting to said annular foot and leg portions, said leg and ankle portions having a back section, and said leg portion having an upright zipper extending substantially the entire height of said back section of said leg portion.

2. An aquatic boot for use in water to strengthen muscles, improve muscle tone and enhance muscular coordination, comprising:

an aquatic foot section for fitting against a top portion of a person's foot;

an aquatic leg section for fitting against a front portion of the person's lower leg;

an aquatic ankle section connecting said aquatic foot section to said aquatic leg section for fitting upon a front portion of the person's ankle;

each of said sections having at least one fin;

a curved flexible aquatic sock connected to said sections for receiving a substantial portion of the person's foot, ankle, and lower leg;

said fin comprising at least one generally N-shaped fin; and said sections having lateral slits defining fluid flow passageways for more smoothly moving said boot in said water.

3. An aquatic boot for use in water to strengthen muscles, improve muscle tone and enhance muscular coordination, comprising:

an aquatic foot assembly for fitting against a top portion of a person's foot;

an aquatic leg assembly for fitting against a front portion of the person's lower leg;

an aquatic ankle assembly connecting said aquatic foot assembly to said aquatic leg assembly for fitting upon a front portion of the person's ankle;

each of said assemblies having an internal pad; and a rounded flexible aquatic sock connected to said assemblies for receiving a substantial portion of the person's foot, ankle, and lower leg; and each of said assemblies having a water-engageable deflector with a water resistant front face and a pair of laterally opposite generally Z-shaped side fins extending laterally outwardly from and integrally connected to said front face.

4. An aquatic boot in accordance with claim 3 wherein said aquatic sock is fastened to said pads by snaps.

5. An aquatic boot in accordance with claim 3 wherein said aquatic sock is glued to said assemblies.

6. An aquatic boot in accordance with claim 3 including fabric straps for adjustably securing and tightening said aquatic sock adjacent said deflector and said straps are threadedly connected to said sock.

7. An aquatic boot in accordance with claim 3 wherein aquatic sock has a foot portion for opening and closing said back section of said leg portion with an open front end.

8. An aquatic boot in accordance with claim 3 wherein said aquatic sock has a leg portion with flaps and fastener means for detachably connecting said flaps.

9. An aquatic boot for use in water to strengthen muscles, improve muscle tone and enhance muscular coordination, comprising:

an aquatic composite lower leg assembly for fitting against and generally conforming to the shin and lower front portion of a person's lower leg;

an aquatic composite foot assembly for fitting upon and generally conforming to a top portion of the person's foot;

an aquatic composite ankle assembly positioned between and pivotally connected to said aquatic leg assembly and said aquatic foot assembly for fitting against and generally conforming to a front portion of the person's ankle;

an aquatic composite sock assembly connected to said foot, ankle, and leg assemblies for snugly receiving, engaging against, and covering substantial portions of the person's foot, ankle, and lower leg;

said aquatic composite leg assembly comprising a water-engageable shin deflector with a water resistant forwardly facing front shin face and a symmetrical pair of complementary generally Z-shaped shin fins extending laterally outwardly from said front shin face and an elastomeric shin pad positioned rearwardly of and engaging said shin deflector;

said front face of said shin deflector having a lower edge portion with a pair of upright countersunk, inverted U-shaped recesses;

said aquatic composite foot assembly comprising a water-engageable foot deflector with a water resistant upwardly facing front foot face and a symmetrical pair of complementary generally Z-shaped foot fins extending laterally outwardly from said upwardly facing front foot face and an elastomeric foot pad positioned downwardly of and engaging said foot deflector;

said front face of said foot deflector having an upper edge portion with a pair of countersunk U-shaped recesses;

said aquatic composite ankle assembly comprising a water-engageable ankle deflector with a water resistant front ankle face and a symmetrical pair of complementary generally Z-shaped ankle fins extending laterally outwardly from said front ankle face and an elastomeric ankle pad positioned rearwardly of and engaging said ankle deflector;

said front ankle face of said ankle deflector having an upper edge portion with a pair of upper U-shaped recesses positioned in alignment with the inverted U-shaped recesses of said shin deflector and having a lower edge portion with a pair of lower inverted U-shaped recesses positioned in alignment with the U-shaped recesses of said foot deflector;

hinge assemblies comprising upper upright oblong hinges and lower oblong hinges, said upper upright oblong hinges positioned in said inverted U-shaped recesses of said shin deflector and said upper U-shaped recesses of said ankle deflector for pivotally connecting and substantially preventing lateral movement between said shin deflector and ankle deflector, said lower oblong hinges substantially aligned with said upper hinges and positioned in said lower inverted U-shaped recesses of said ankle deflector and said U-shaped recesses of said foot deflector for pivotally connecting and substantially preventing lateral movement between said foot deflector and said ankle defector;

each of said deflectors having a substantially parallel pair of elongated braces comprising elongated crossbars extending outwardly of and substantially horizontally across said front face of said Z-shaped fins;

said deflectors, fins, and hinges comprising impact-resistant plastic;

said Z-shaped fins being substantially rigid and stationary and integrally connected to and in fixed relationship to their adjacent corresponding deflector, said Z-shaped fins having inner generally V-shaped front pockets and outer generally V-shaped back pockets for cuppingly and resistively engaging the water as said aquatic boot is moved forwardly and rearwardly in the water, said Z-shaped fins having an inner generally rectangular fin, an outer polygonal fin with curved rounded edges, an intermediate generally rectangular fin positioned between and connecting said inner and outer fins, an inner bight connecting and cooperating with said inner and intermediate fins to provide said V-shaped front pocket, and an outer bight connecting and cooperating with said intermediate and outer fins to provide said V-shaped back pocket, said outer bight having a generally rectangular back portion;

said fins and front faces having substantially water-impervious portions providing water-resistive impingement surfaces for hydrodynamically deflecting water and creating pressure heads and multi-directional fluid resistance to water flow as said aquatic boot is moved forwardly, rearwardly, upwardly, and downwardly through the water;

said inner bights of said ankle and leg assemblies having generally rectangular front bight portions and said inner bights of said foot assembly having generally triangular front bight portions for enhancing fluid resistance to water flow as said aquatic boot is moved forwardly and upwardly through the water;

each of said assemblies having a substantially parallel pair of reinforcing cross members extending substantially horizontally across said front bight portions and connecting said inner and intermediate fins, said cross members being positioned between said braces;

said aquatic composite sock assembly comprising an elastomeric flexible, tubular sock with an annular foot portion, an annular lower leg portion, and an annular ankle portion extending between and integrally and annularly connecting said annular foot and leg portions, said annular foot portion having an open front toe portion and a concave composite sole comprising an elastomeric core, an upwardly facing cloth lining, and a downwardly facing hardened rubberized coating with diamond shaped ribs for minimizing wear when said aquatic boot rubs against, steps upon, and engages the bottom of a swimming pool or the sandy or stony bottom of the water, said annular ankle portion having a rounded heel portion, and said annular lower leg portion having a concave back portion and an upright zipper extending substantially the entire height of said concave back portion; and said fins being positioned an effective distance from said front faces and comprising hydrodynamic resistance assemblies for exerting a hydrodynamic torque on the leg, ankle and foot to strengthen the muscles of the leg, ankle and foot as said aquatic foot is moved through the water.

10. An aquatic boot in accordance with claim 9 wherein said concave sole has an enlarged thickness defining a wear resistant zone about the ball of the person's foot to increase the useful life of said aquatic sock.

11. An aquatic boot in accordance with claim 9 wherein said inner bights have strap-receiving holes and said aquatic boot further comprises flexible water-resistant straps sewn to said aquatic sock assembly, said straps extending through said strap-receiving holes, and substantially D-shaped rings for adjustably connecting and tightening said straps about said deflectors.

* * * * *